US009466925B2

(12) United States Patent
Rost et al.

(10) Patent No.: US 9,466,925 B2
(45) Date of Patent: Oct. 11, 2016

(54) PADDLE CARD ASSEMBLY FOR HIGH SPEED APPLICATIONS

(71) Applicant: Molex, LLC, Lisle, IL (US)

(72) Inventors: Michael Rost, Lisle, IL (US); Mark Alan Bugg, Maumelle, AR (US); Darian Ross Schulz, Little Rock, AR (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/637,551

(22) Filed: Mar. 4, 2015

(65) Prior Publication Data

US 2015/0311642 A1 Oct. 29, 2015

Related U.S. Application Data

(63) Continuation-in-part of application No. 13/745,329, filed on Jan. 18, 2013, now abandoned.

(51) Int. Cl.

| | |
|---|---|
| ***H01R 12/24*** | (2006.01) |
| ***H01R 13/6592*** | (2011.01) |
| ***H01R 9/03*** | (2006.01) |
| ***H01R 12/53*** | (2011.01) |
| ***H01R 12/72*** | (2011.01) |

(52) U.S. Cl.

CPC ..... *H01R 13/6592* (2013.01); *H01R 9/032* (2013.01); *H01R 12/53* (2013.01); *H01R 12/721* (2013.01)

(58) Field of Classification Search

CPC ..... H01R 23/662
USPC ..... 439/497, 579
See application file for complete search history.

(56) References Cited

U.S. PATENT DOCUMENTS

| | | | | |
|---|---|---|---|---|
| 3,770,874 | A | 11/1973 | Krieger et al. | |
| 4,602,832 | A | 7/1986 | Cunningham et al. | |
| 4,627,674 | A * | 12/1986 | Hamsher, Jr. | H01R 12/718 439/296 |
| 4,639,054 | A * | 1/1987 | Kersbergen | H01R 12/62 200/292 |
| 4,682,828 | A * | 7/1987 | Piper | H01R 12/62 29/857 |
| 4,871,319 | A | 10/1989 | Babow | |
| 4,993,968 | A | 2/1991 | Guletsky et al. | |
| 5,057,650 | A * | 10/1991 | Urushibata | H01R 13/504 174/72 A |
| 5,122,065 | A * | 6/1992 | Dudek | H01R 23/662 439/108 |
| 5,190,473 | A * | 3/1993 | Mroczkowski | H01R 13/6593 439/580 |

(Continued)

*Primary Examiner* — Neil Abrams
(74) *Attorney, Agent, or Firm* — Stephen L. Sheldon

(57) ABSTRACT

A paddle card assembly is disclosed for use in providing a high speed transmission line for connecting electronic devices together. The paddle card takes the form of a circuit board that has two distinct portions, a base portion to which wires of a cable are terminated, and an extension portion that extends rearwardly toward the cable wire in order to extend between sets of wires. The extension portion has one or more ground plane layers formed therewith and supported thereby and as such, the extension portion places a ground plane in the termination area of the connector, rear of the trailing edge of the paddle card to provide shielding between pairs of wires on opposite sides of the paddle card where the cable shields are cut back. The extension portion may have either a reduced thickness, or wire-receiving channels formed therein which accommodate portions of the wires of the cable.

12 Claims, 4 Drawing Sheets

(56) References Cited

U.S. PATENT DOCUMENTS 5,241,135 A 8/1993 Fetzer
5,364,292 A 11/1994 Bethurum
5,679,008 A 10/1997 Takahashi et al.
5,764,489 A * 6/1998 Leigh ..... H05K 1/0219 174/261
5,810,620 A 9/1998 Kobayashi et al.
6,139,364 A 10/2000 Beutler et al.
6,190,196 B1 2/2001 Kato
6,232,556 B1 * 5/2001 Daugherty ..... H01R 12/61 174/88 R
6,351,884 B1 * 3/2002 Damaschke ..... G01K 7/18 29/842
6,371,805 B1 4/2002 Wang et al.
6,431,887 B1 8/2002 Yeomans et al.
6,575,772 B1 6/2003 Soubh et al.
6,617,939 B1 9/2003 Vermeersch
6,645,001 B2 * 11/2003 Okano ..... H01R 12/592 439/492
6,661,318 B2 12/2003 Tamaki et al.
6,685,511 B2 2/2004 Akama et al.
6,740,822 B2 5/2004 Watanabe
6,857,898 B2 2/2005 Engquist et al.
6,869,308 B2 * 3/2005 Wu ..... H01R 12/62 439/497
6,880,241 B2 4/2005 Edwardsen et al.
6,893,270 B2 5/2005 Sercu
6,927,655 B2 8/2005 Torigoe et al.
6,994,563 B2 2/2006 Amini et al.
7,046,020 B2 5/2006 LaMeres et al.
7,131,862 B2 11/2006 Vermeersch
7,223,915 B2 5/2007 Hackman
7,244,126 B2 7/2007 Morana et al.
7,267,575 B1 * 9/2007 Hwang ..... H01R 9/034 439/497
7,412,923 B2 8/2008 Shaeffer et al.
7,462,065 B1 * 12/2008 Zhao ..... H01R 12/592 439/497
7,462,071 B1 12/2008 Wu
7,498,523 B2 * 3/2009 Miller ..... H01R 9/0515 174/261
7,510,425 B2 * 3/2009 Kuo ..... H05K 3/3405 439/493
7,520,757 B2 4/2009 Bartholomew
7,637,779 B2 12/2009 Nagata et al.
7,648,372 B2 1/2010 Wu
7,887,339 B2 * 2/2011 Kumamoto ..... H01R 9/035 439/108
8,039,746 B2 * 10/2011 Ashida ..... H01R 12/592 174/88 R
8,106,296 B2 * 1/2012 van Tiel ..... H01R 12/53 174/70 R
8,133,071 B2 * 3/2012 Huang ..... H01R 12/778 439/499
8,337,243 B2 12/2012 Elkhatib et al.
8,614,398 B2 12/2013 Regnier et al.
8,662,917 B2 3/2014 Wang et al.
8,672,689 B2 * 3/2014 Tseng ..... H01R 12/62 439/493
8,696,378 B2 4/2014 Behziz et al.
8,753,143 B2 * 6/2014 Su ..... H01R 12/594 439/492
8,758,051 B2 6/2014 Nonen
8,845,364 B2 * 9/2014 Wanha ..... H01R 13/516 439/607.07
9,035,183 B2 * 5/2015 Kodama ..... H05K 1/18 174/74 R
9,049,787 B2 * 6/2015 Bugg ..... H01R 9/032
2006/0228935 A1 10/2006 Wen
2006/0228942 A1 10/2006 Okano et al.
2006/0252310 A1 11/2006 Yamada et al.
2011/0306244 A1 * 12/2011 Zhang ..... H01R 9/034 439/624
2014/0206230 A1 * 7/2014 Rost ..... H01R 13/6591 439/607.01

* cited by examiner

FIG.5
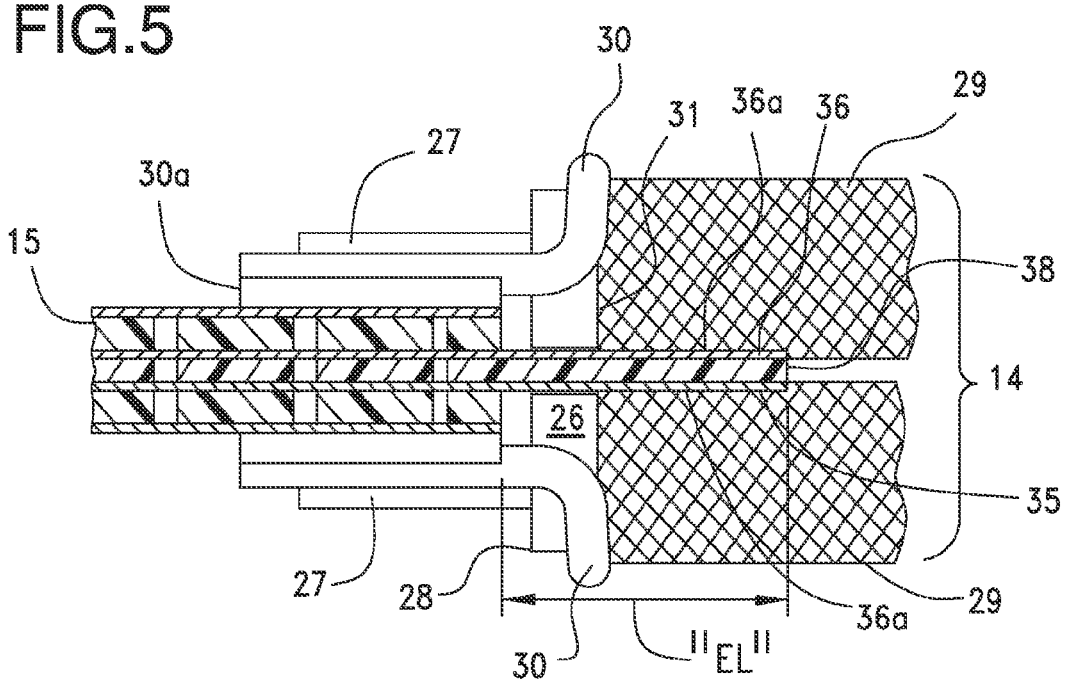
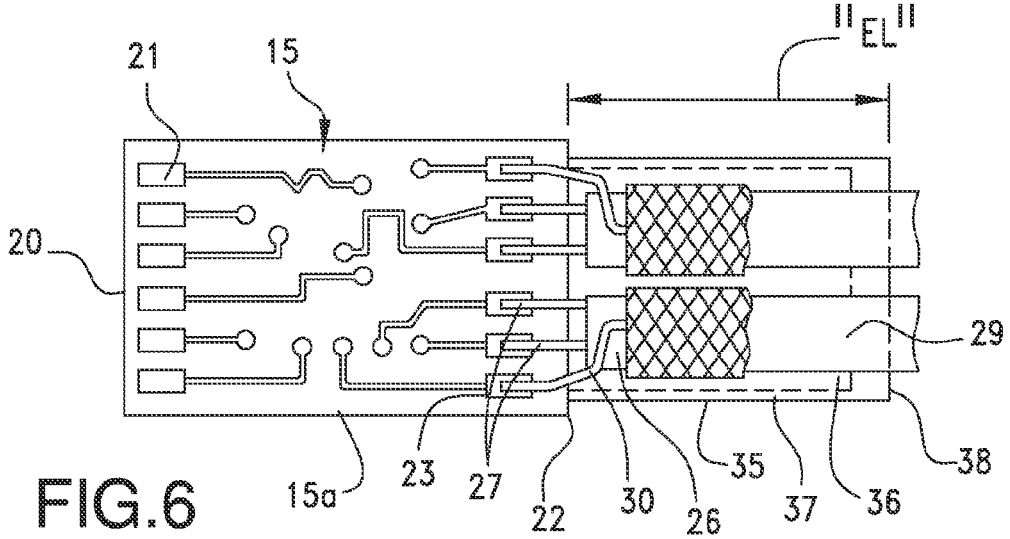
FIG.6
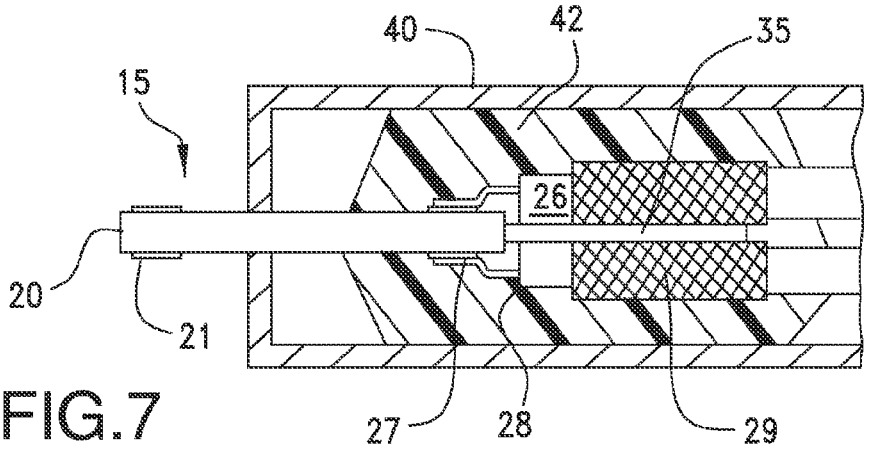
FIG.7

PADDLE CARD ASSEMBLY FOR HIGH SPEED APPLICATIONS

REFERENCE TO RELATED APPLICATIONS

The Present Disclosure is a Continuation-in-Part Application of prior-filed U.S. patent application Ser. No. 13/745,329, entitled "Paddle Card Assembly for High Speed Applications," filed on 18 Jan. 2013 with the United States Patent and Trademark Office. The content of the aforementioned Patent Application is incorporated in its entirety herein.

BACKGROUND OF THE PRESENT DISCLOSURE

The Present Disclosure relates generally to cable interconnection systems, and, more particularly, to improved cable assemblies for use in high speed data transmission applications.

Conventional cable interconnection systems are found in electronic devices such as routers, servers and the like, and are used to form signal transmission lines. These transmission lines may extend between chip members and connectors, connectors in two different devices, and between devices themselves. Often, differential signal wires are used for each such transmission line in a cable and although it is easy to maintain a desired impedance profile along the length of the cable due to the cable geometry, it is difficult to maintain such a profile at the termination ends of the wires. In some instances, these terminations occur at circuit board that takes the form of an edge, or paddle, card. The wires are terminated to contact pads along the trailing edge of the circuit board. In such a situation, the exterior insulation is stripped back and the bare conductors are terminated to solder pads or the like. Removing the exterior insulation also requires removing the outer shield of the cable wires so that the termination area is left poorly grounded. This ungrounded area has been known to contribute to and increase the crosstalk between the wires in high speed applications. It is desirable to therefore have a cable termination with a structure that lessens the discontinuities in impedance profiles.

The Present Disclosure is therefore directed to a cable assembly particularly suitable for high speed data transmission applications.

SUMMARY OF THE PRESENT DISCLOSURE

Accordingly, there is provided an improved high speed cable assembly having an improved termination structure suitable for beneficial termination in high speed data transmission applications.

In accordance with an embodiment as described in the following disclosure, a cable assembly is disclosed that utilizes a specially configured circuit board, or paddle card, to which the wires of the cable are terminated. The circuit board is formed with two distinct sections, the first of which may be considered to be a base portion on which a majority of the circuit board circuitry resides, including the front contact pads which engage terminals of an opposing mating connector, as well as the contact pads to which pairs of the cable wires are terminated. The second portion may be considered to be an extension of the first portion but it has a different and lesser thickness than the circuit board base portion. It extends rearwardly of the base portion and the contact pads.

One or more ground plane layers are preferably extended into the area of the circuit board extension portion, rearwardly of the contact pads, and these ground plane layers may be th kim e only circuitry of the circuit board that is supported by the extension portion. Ordinarily the cable wires have their insulation covering and exterior shields stripped from the ends thereof in order to expose free ends of the cable wire conductors, so that the conductors may be easily terminated to the circuit board along the rearmost set of contact pads thereof. In stripping the cable wires, the conductors have a bare extent, and the insulative or dielectric covering of the wires also has a given extent that extends between the leading edge of the insulative covering and the leading edge of the exterior shield. Ordinarily in dense cable connectors, differential signal pairs are arrayed in rows along the top and bottom surfaces of the circuit board. The conductors of the wire pairs are terminated to contact pads on opposite sides of the circuit board and the ends of the insulation of the wire pairs are disposed rearwardly of the circuit board trailing edge. The ends of the exterior shielding are likewise disposed rearwardly of the circuit board trailing edge and rearwardly of the ends of the cable wire insulation and as such, a gap occurs between the wire pairs attached to the top and bottom surfaces of the circuit board. This area is prone to increasing crosstalk and negatively influencing discontinuities in the impedance profile of the cable assembly.

The extension portion of the circuit board extends rearwardly into this gap between the leading edge of the shield and the trailing edge of the circuit board. It fills the intervening space between top and bottom pairs of cable wires, and because the extension portion supports at least one ground plane layer, it provides shielding between aligned pairs in the vertical direction of the cable assembly. This shielding reduces crosstalk in the termination area, without the need for additional, separate shielding components. The extension portion has a thickness that is less than the thickness of the circuit board base portion so that the circuit board has a stepped configuration when it is viewed from the side. The thickness of this extension portion may be chosen to provide a spacing template for the cable wires as it will preferably fit snugly in the horizontal gap that exists in the vertical direction between wires on opposite surfaces of the circuit board. The reduction in crosstalk between the vertically aligned wires without utilizing additional components, offers a cost saving in manufacturing of cable assemblies of the Present Disclosure. Moreover, the stepped profile of the circuit board provides for an intervening element that can assist in providing strain relief to the cable assembly when the circuit board is overmolded with an insulative material at least in the termination area. Suitable overmolding materials include plastics and/or epoxies.

In another embodiment, the extension portion has the same thickness as the remaining portion of the circuit board, and is configured to receive the cable wires by way of one or more cavities, or channels, formed in the extension portions. The cavity is preferably formed in the circuit board insulative layer to a depth such that the conductors extend out of the cable wires at the surface of the circuit board, so there is no relatively large spacing therebetween that could affect the connection between the wires and the circuit board. In other words, the wire conductors extend out of the wires at an elevation where the bottom surfaces of the conductors will match the upper surface of the termination areas on the circuit board. In this manner, virtually no stress is created at the conductor-circuit board junction and the conductor and wire will not induce any stress on these junctions.

In this embodiment, one cavity may be formed in the circuit board extension portion which accommodates a wire pair. In yet another embodiment, a pair of cavities may be formed in the surfaces of the circuit board extension portions to accommodate each wire pair. In some connectors constructed in accordance with the present disclosure the cable may have two wire pairs and, as such, the circuit board extension portion can accommodate two pairs of cavities while in other connectors, there may be four-to-six differential signal pairs and thus single cavities will need to accommodate each differential wire pair. The cavities may extend down to the inner ground plane or they may include a thin layer of board material over them to prevent accidental shorting.

These and other objects, features and advantages of the Present Disclosure will be clearly understood through a consideration of the following detailed description.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which:

FIG. 5 is a sectional view of a cable-circuit board assembly constructed in accordance with the principles of the Present Disclosure;

FIG. 6 is a top plan of the cable-circuit board assembly of FIG. 5;

FIG. 7 is a sectional view of a cable connector with the cable-circuit board assembly of FIG. 6 housed thereby and with an overmolded body portion;

DESCRIPTION OF THE PREFERRED EMBODIMENTS

Figure 1:
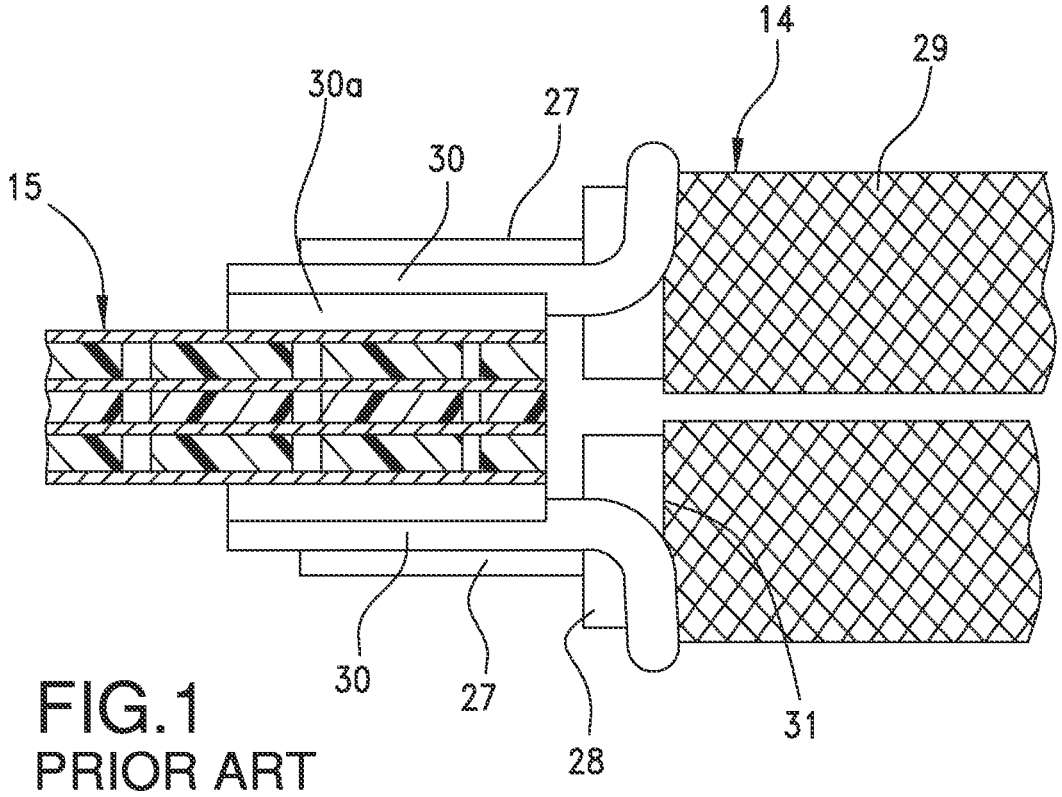
FIG.1 PRIOR ART
FIG. 1 illustrates a sectional view taken through the termination area of a conventional cable-circuit board assembly.
Figure 2:
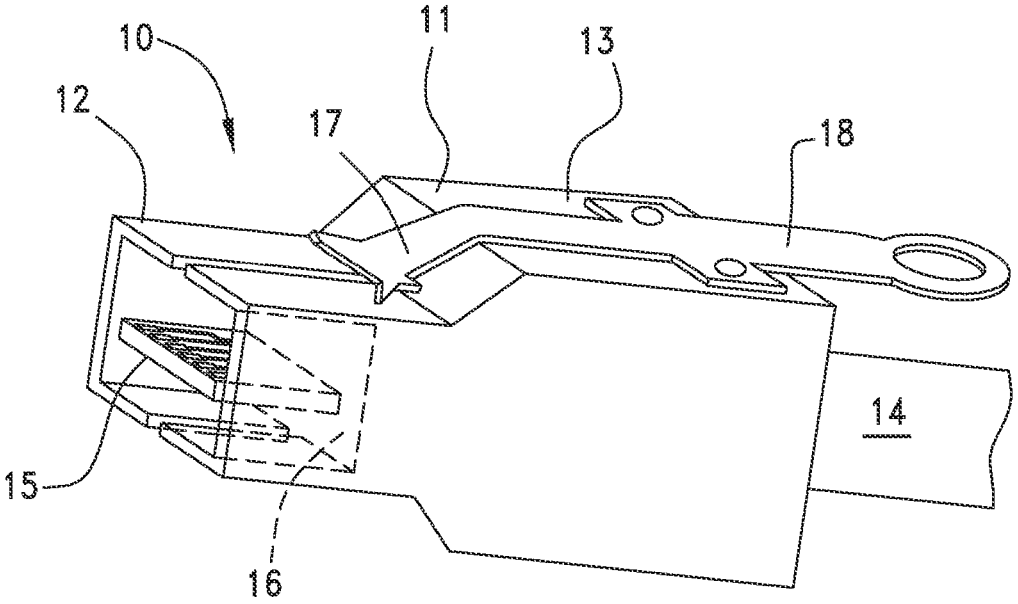
FIG. 2 is a perspective view of typical cable connector housing in which cable-circuit board assemblies of the type illustrated in FIG. 1 are housed.

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

FIGS. 1-4 illustrate a conventional cable connector 10 that has a protective outer connector housing 11 with a hollow termination end 13 that receives an end of a multiple-wire cable 14 and which is connected to a smaller mating end 12. The mating end 12 of the connector holds a mating blade, shown as a circuit board, or paddle card, 15 in an orientation that is suitable for mating with an opposing, mating receptacle connector (not shown) that has a slot which receives the forward end of the circuit board 15. In order to provide a means for enuring engagement with the opposing connector after mating with it, the connector 10 is preferably provided with an elongated latch member 17 with engagement tabs at its forward end that are received in openings formed in the opposing connector. The latch member 17 is actutaed by the manipulation of an actuator 18, shown as a pull tab.

Figure 3:
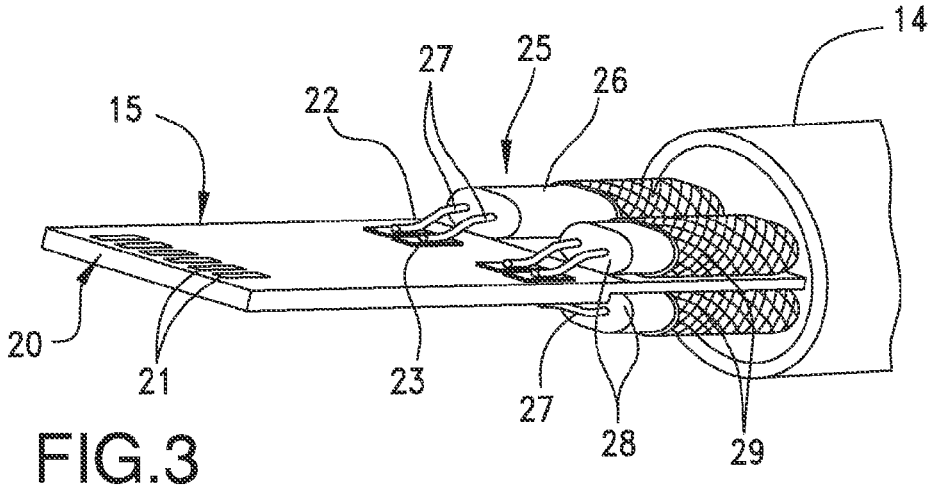
FIG.3 PRIOR ART
FIG. 3 is a perspective view of the cable-circuit board assembly of FIG. 1.

FIG. 3 is a perspective view of a conventional termination structure used in to connect individual wires 25 of the cable 14 to circuits on the circuit board 15. As shown, the cable 14 encloses a plurality of wires 25. The wires illustrated are of the twin-ax construction, meaning that they have a dedicated pair of signal conductors 27 running along their lengths and in a spaced-apart fashion. In this context "dedicated" means a pair of wires that are used to transmit differential signals between electronic devices. The conductors 27 are held in place by an outer insulative and dielectric covering 26. The dielectric covering 26 is itself enclosed by an outer shield member 29. The shield member 29 shown is a braided wire, conductive shield, and outer conductive materials are used, such as copper foil and the like.

Figure 4:
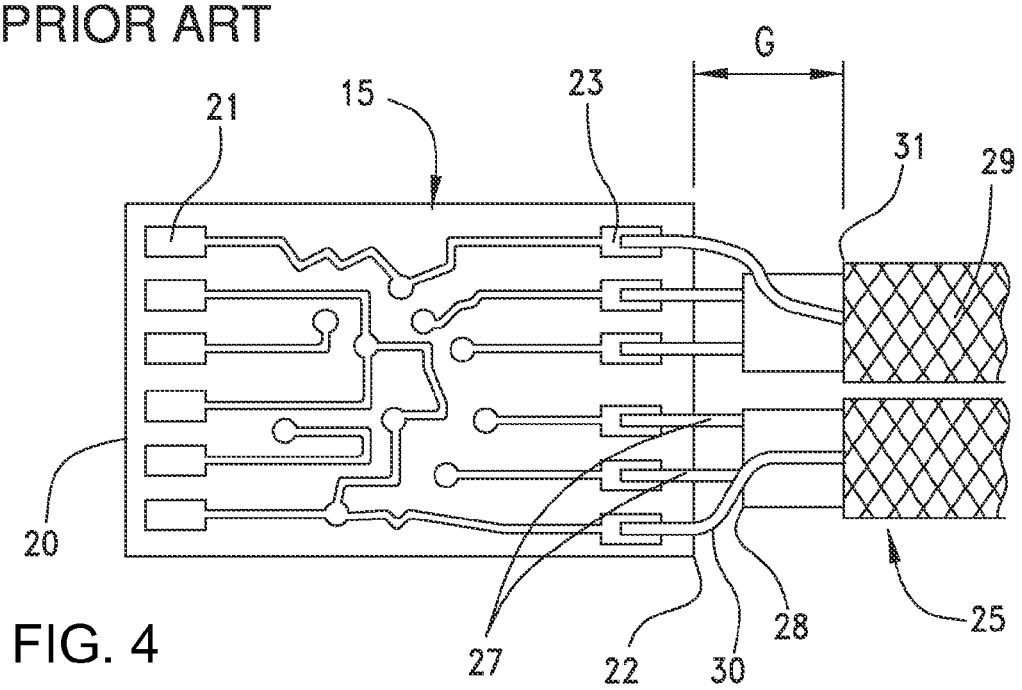
FIG. 4 PRIOR ART
FIG. 4 is a top plane view of the cable-circuit board assembly of FIG. 1.

Turning to FIG. 4, which is a plan view of the termination structure shown in FIG. 3, it can be seen that the circuit board 15 takes the general form of a rectangle and has a leading edge 20 and a trailing edge 22. The leading edge 20 is the forwardmost edge of the circuit board 25 and is that portion of the circuit board that is inserted into the card-receiving slot of an opposing, mating connector. In that regard, the circuit board 15 is typically formed with an array of conductive contact pads 21 that mate with terminals of the opposing connector. Similarly, the trailing edge 22 of the circuit board 15 defines an area where the free ends of the cable wire conductors 27 are terminated to the circuit board 15. As such, the circuit board 15 has an array of contact pads 23 arranged in a pattern proximate to the trailing edge 22 of the circuit board 15.

In termination, the free ends of the cable wire conductors 27 are exposed by removing a given length of their outer covering 26, and the outer shield member 29 also has a portion of it removed. This removal defines respective leading edges 28, 31 of both the wire insulation 26 and the shield member 29, both of which are spaced apart from the ends of the cable wire conductors. These leading edges 28, 31, as best shown in FIG. 4, also are spaced rearwardly of the circuit board contact pads 23 and the trailing edge 22 of the circuit board 15. This difference defines a gap "G" through which the cable wire conductors 27 extend, both in their bare condition and in their insulated, but unshielded transmission. Drain wires 30 associated with each twin-ax pair may be provided and they are separately attached to the circuit board either by direct attachment or by way of a cradle 30*a* and connected to an internal ground plane layer of the circuit board 15.

In this gap area G, the cable wire shields 29 are removed and when the cable wires 25 are terminated to the circuit board 15, they are typically aligned with each other in pairs, vertically. That is, some pairs of the cable wires 25 are attached to the top surface of the circuit board 15, while a like amount of cable wires 25 are attached to the bottom surface of the circuit board 15. The pairs are arranged both side by side in two, generally horizontal planes, but the pairs in these planes are separated from each other by a vertical spacing that is at least equal to the thickness of the circuit board. In the gap area, G, where the cable wire shielding has been removed the signal wires of the cable are closely spaced apart from each other, and any ground plane that may be utilized in the circuit board construction stops near the trailing edge of the circuit board 15. Hence, there is no shielding in this gap area between the vertically spaced apart wire pairs. Even though the gap distance is relatively small, at high data transfer speeds, such as 10 Gigabits per second (Gbps) crosstalk occurs and rises to a level that is deleterious to efficient signal transmission and may lead to discontinuities in the impedance profile of the cable assembly. This crosstalk is even greater at data transfer speeds of 25 Gbps.

FIGS. 5-6 illustrate one embodiment of our solution to this problem. The circuit board 15 has been reconfigured and now has two distinct portions. The first portion may be considered as a base portion 15*a* which supports the arrays of front and rear contact pads 21, 23 and circuitry interconnecting them together, while the second portion may be considered as an extension portion 35 that extends past the circuit board trailing edge 22 and through the gap area G for a given length "EL" that terminates at the end 38 of the extension portion 35. The front contact pads 21 are used as mating contacts for mating the circuit board with an opposing connector (not shown), while the rear contact pads 23 are used as termination points for the free ends of the conductors 27 of the cable wires 25. As used for this embodiment, the term "trailing edge" refers to the rearmost edge of the circuit board base portion along which the rear contact pads 23 are arranged, and it will be understood that the extension portion extends past this trailing edge. The rear edge of the extension portion 35 is not considered as the trailing edge of the circuit board 15. The rear contact pads 23, particularly the rear edges thereof, also serve to approximately define the end of the base portion 15*a* and the beginning of the extension portion 35, as noted in the embodiments described below.

As best shown in FIG. 5, the two circuit card portions 15, 35 have different thicknesses, such that when viewed from the side, the circuit board 15 has a stepped profile. The circuit board base portion 15*a* has a first thickness and the circuit board extension portion 35 has a second thickness, which is less than the first thickness. The circuit board extension portions 35 includes at least one ground plane layer 36 that preferably extends from the base portion 15 into the extension portion 35.

Two such ground plane layers 36*a*, 36*b* are illustrated in FIG. 5 as the most preferred structure and it can be seen that the ground plane layers 36*a*, 36*b* are spaced apart vertically. The circuit board extension portion 35 and its associated ground plane layer(s) 36 extend rearwardly, for a given distance, past the leading edges 28, 31 of the wire insulation 26 and shields 29 filling the gap area G complete with an associated ground to which the exposed portions of the wire conductors may couple, rather than with each other. The ground plane layers 36*a*, 36*b* may be slightly smaller than the circuit board extension portion width, as shown in FIG. 6 so that a margin or setback area 37 is defined to prevent contact between the connector housing 40, which often is conductive, and the ground plane layers 36 if that is desirable in the connector construction. Alternatively, there may be application where the ground plane layers 36 are desired to contact the connector housing and thus no margin area 37 would be needed.

Such a structure reduces the crosstalk that occurs in this area, especially at high data transfer speeds of 10 Gbs up to 25 Gbps and above. The use of the circuit board extension portion 35 to solve this problem does so without increasing the complexity of assembly and manufacturing costs as it accomplishes a reduction in crosstalk without attaching any extra component. Crosstalk has been able to be reduced up to 15 dB between the adjacent top and bottom rows of twin-ax wires without adding any extra components to the cable assembly.

This new development also provides the user with the ability to integrate a strain relief aspect into the termination area. This may be done by forming a body portion utilizing a suitable material such as a plastic or an epoxy. As shown in FIG. 7, the body portion 42 extends over the termination area and the free ends of the wire conductors 27 and the leading edge 28 of the wire insulation and leading edge 31 of the wire shields 29, as well as the entire circuit board extension portion 35. This overmolded body portion 42 may be configured to contact the inner walls of the connector housing 40. Additionally the thickness of the circuit board extension portion 35 may be set so that the cable wires 25 lie flat thereupon and their center conductors 27 extend at a level where they also lie flat on the top and bottom surfaces of the circuit board base portion 15 thereby dispensing with the need to bend the conductors down so that they will touch the rear contact pads 23.

Figure 8:
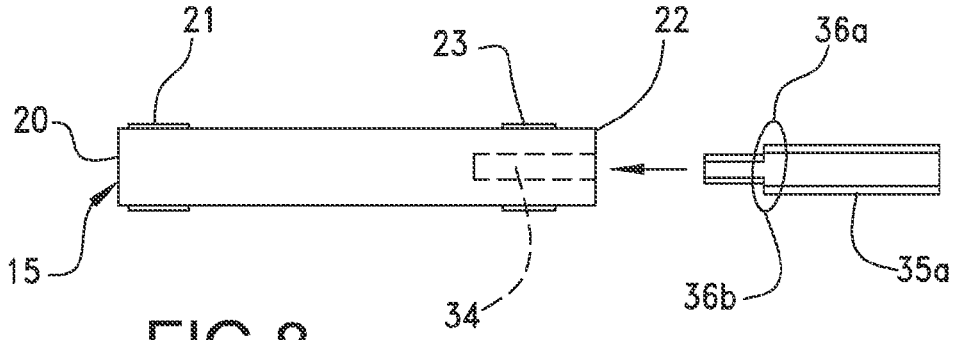
FIG. 8 is a side elevational view of an alternate circuit board construction, in which the circuit board extension portion is inserted into the circuit board base portion.

Preferably, the circuit boards of the Present Disclosure are integrally formed as one piece as shown in FIG. 5. Alternatively, it is contemplated that the extension portion 35*a* may be formed separately and inserted into the circuit board base portion 15 as shown in FIG. 8. The circuit board base portion 15 preferably is formed with a slot 34 that receives a tongue or blade portion of the extension portion 35. The ground plane layers 36*a*, 36*b* are preferably formed on opposing surfaces of the extension portion 35*a* and the mating blade for contacting ground plane connections within the circuit board base portion slot 34.

Figure 9:
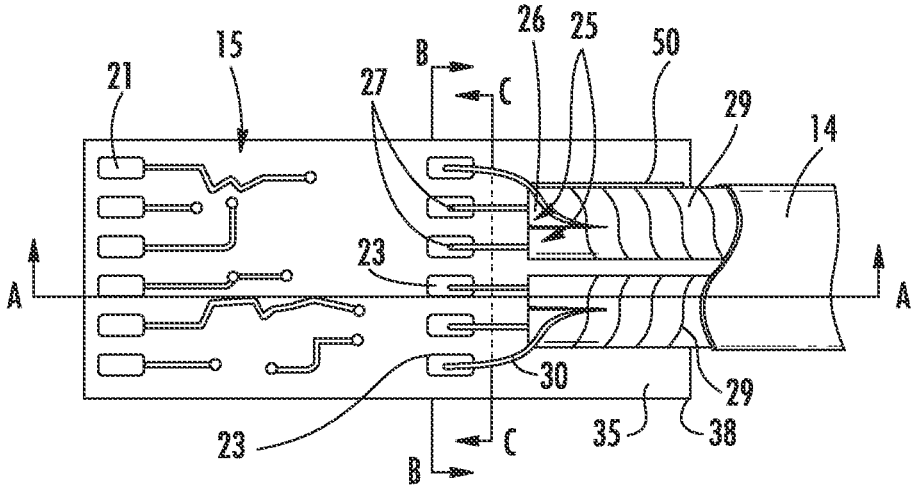
FIG. 9 is a top plan view of an alternate construction of a circuit board, used in cable-circuit board assemblies of the disclosure, which utilizes channels in the circuit board extension portion and which receive the cable wires therein.
Figure 9A:
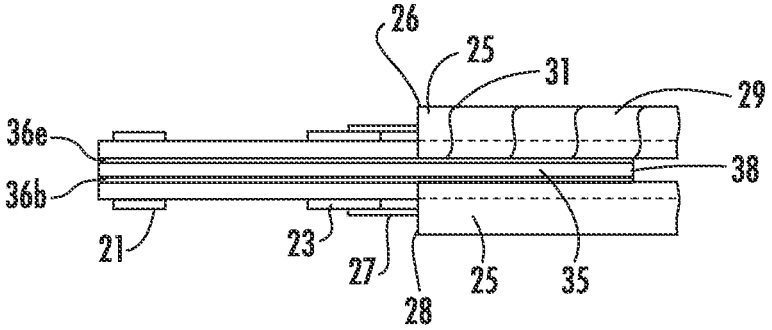
FIG. 9A is a longitudinal sectional view of the cable-circuit board assembly of FIG. 9, taken along Line A-A thereof.
Figure 9B:
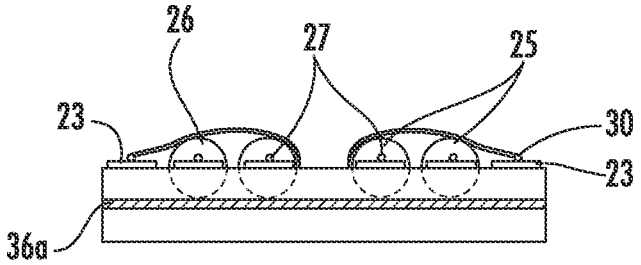
FIG. 9B is a transverse sectional view of the cable-circuit board assembly of FIG. 9, taken along Line B-B thereof.
Figure 9C:
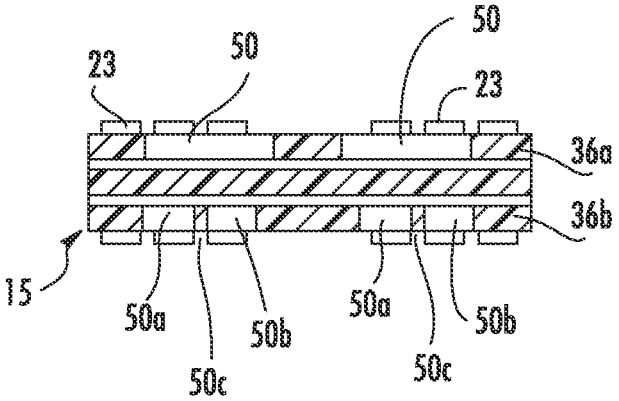
FIG. 9C is another transverse sectional view of the cable-circuit board assembly of FIG. 9, taken along Line C-C thereof.

FIGS. 9-9C describe an alternate construction of an improved circuit board assembly in accordance with the principles of the Present Disclosure. As illustrated in FIG. 9, the base portion 15*a* and the extension portion 35 of the circuit board 15 are formed as a single piece with the portions 15*a*, 35 having different thicknesses as noted above. In order to provide the cable wires 25 with some securement to the circuit board 15, the circuit board extension portion 35 preferably includes one or more channels, or cavities 50 that are formed in at least one surface thereof and which extend longitudinally. The channel(s) 50 may be formed such as by laser ablation in the circuit board material, typically FR4 or the like, or they may be ground or otherwise cut. The channels 50 may have a depth sufficient so that one of the ground planes 36*a*, 36*b* is exposed and preferably they have a depth such that the signal conductors 27 exit from the cable wires 25 and sit substantially flat upon the rear, termination contact pads 23. This is illustrated in FIGS. 9A-9B. Alternatively, there may be a need to retain some of the circuit board material covering the ground plane. Similarly, in circuit boards that also contain a power plane, the power plane may be removed from the channel to reduce the risk of shorting.

Importantly, the depth is sufficient enough so that the signal conductors lie substantially flush on their associated termination contact pads. In this manner the crosstalk relief is obtained and most of the strain associated with the signal conductors' attachment to the circuit board 15 is eliminated. The channels 50 may be formed individually so that one channel 50*a* or 50*b* accommodates one wire of a dedicated wire pair, as illustrated in FIG. 9C, with the channels 50*a*, 50*b* being separated by an intervening portion 50*c* of the circuit board 15. Or, the channel 50 may be a single, wide channel as illustrated in FIG. 9B that accommodates the pair of cable wires. In practice, a depth of 16 mils has produced good results.

Although the Present Disclosure has described our new development in terms of twin-ax wires, it will be understood that the principles thereof apply equally to pairs of differential signal wires used in cables where each wire had a center conductor surrounded by an insulative covering and the two wires are enclosed within an outer shielding member. In such an instance, the wires are arranged to align with corresponding contact pads and the insulation on each wire is trimmed back as is the outer shielding member for each such pair of wires, so that the leading edges of the wire insulation and the outer shielding members are disposed rearwardly of the circuit board base portion trailing edge so that the circuit board extension portion may be positioned therebetween in the manner described above.

Finally, while a preferred embodiment of the Present Disclosure is shown and described, it is envisioned that those skilled in the art may devise various modifications without departing from the spirit and scope of the foregoing Description and the appended Claims.

What is claimed is:

1. An improved cable assembly, comprising:

a cable, the cable including a plurality of wires, each wire including a conductor surrounded by an insulative covering and pairs of the wires being wrapped together in an outer shielding member, the conductors of each wire extending past a leading edge of the insulative covering to define free termination ends of the wires, and the outer shielding member having a leading edge spaced rearwardly from the insulative covering free ends;

a circuit board having opposite leading and trailing edges and opposite first and second surface, the circuit board including two distinct portions:

a first portion containing a plurality of termination contact pads for connecting circuitry of the circuit board to the wire free ends, and a second portion extending from and spaced apart from the circuit board first portion, the second portion extending rearwardly from the termination contact pads, the cable wire free ends terminating to the termination contact pads, wherein the second portion includes a circuit member inserted into the first portion; and a connector housing enclosing the circuit board and a portion of the cable.

2. The cable assembly of claim 1, wherein the first and second portions have respective first and second thicknesses, the first thickness being greater than the second thickness, so that the circuit board has a stepped profile when viewed from a side thereof.

3. The cable assembly of claim 2, wherein a difference between the first and second thicknesses permits the cable wires to lie upon the second portion such that the cable wire free ends lie generally flat upon the contact pads of the first portion.

4. The cable assembly of claim 2, wherein the cable wires are arranged in at least two wire pairs, one cable wire pair disposed along a first surface of the second portion and the other cable wire pair disposed along a second surface of the second portion, the thickness of the first and second portions being sufficient so that the conductors of each cable wire pair lie substantially flat on the first portion contact pads.

5. The cable assembly of claim 2, wherein wire-receiving channels of the second portion have a depth sufficient so that the conductors of the cable wires lie substantially flat upon the contact pads.

6. The cable assembly of claim 1, wherein the cable wire shield member is a conductive braided shield, and the braided shield of each wire pairs is terminated to the second portion.

7. The cable assembly of claim 1, wherein the second portion includes at least one ground plane layer extending from the first portion into the second portion.

8. The cable assembly of claim 1, wherein the second portion includes a second ground plane layer extending from the first portion into the second portion.

9. The cable assembly of claim 1, wherein the second portion is integrally formed with the first portion.

10. The cable assembly of claim 1, wherein the second portion includes wire-receiving channels, the wire-receiving channels accommodating the cable wires.

11. The cable assembly of claim 10, wherein:

single cable wires are respectively received in single wire-receiving channels; and the second portion includes at least one ground plane therein, and the wire-receiving channels are formed within the second portion with a depth that exposes the ground plane.

12. The cable assembly of claim 1, wherein a portion of the first portion and the second portion are overmolded with a material that fixes the cable wires in place with respect to the circuit board, the overmolded material providing strain relief for the wire free ends.

* * * * *